US011830650B2

(12) United States Patent
Yoshikawa

(10) Patent No.: US 11,830,650 B2
(45) **Date of Patent: *Nov. 28, 2023**

(54) REACTOR

(71) Applicants: AutoNetworks Technologies, Ltd., Yokkaichi-shi (JP); Sumitomo Wiring Systems, Ltd., Yokkaichi (JP); Sumitomo Electric Industries, Ltd., Osaka (JP)

(72) Inventor: Kohei Yoshikawa, Yokkaichi (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 443 days.

This patent is subject to a terminal disclaimer.

(21) Appl. No.: 16/972,124

(22) PCT Filed: May 17, 2019

(86) PCT No.: PCT/JP2019/019765
§ 371 (c)(1),
(2) Date: Dec. 4, 2020

(87) PCT Pub. No.: WO2019/235186
PCT Pub. Date: Dec. 12, 2019

(65) Prior Publication Data

US 2021/0233696 A1 Jul. 29, 2021

(30) Foreign Application Priority Data

Jun. 5, 2018 (JP) ..... 2018-108160

(51) Int. Cl.
*H01F 27/26* (2006.01)
*H01F 27/28* (2006.01)
*H01F 41/02* (2006.01)

(52) U.S. Cl.
CPC ..... *H01F 27/26* (2013.01); *H01F 27/28* (2013.01); *H01F 41/0246* (2013.01)

(58) Field of Classification Search
CPC ..... H01F 27/26; H01F 27/28; H01F 41/0246; H01F 27/255; H01F 27/263; H01F 37/00;
(Continued)

(56) References Cited

U.S. PATENT DOCUMENTS

2002/0014941 A1 2/2002 Yoshioka et al.
2012/0044033 A1 2/2012 Kawaguchi
(Continued)

FOREIGN PATENT DOCUMENTS

JP 2013-030692 A 2/2013
JP 2015-012145 A 1/2015
JP 2017-098426 A 6/2017

OTHER PUBLICATIONS

International Search Report, Application No. PCT/JP2019/019765, dated Jul. 16, 2019. ISA/Japan Patent Office.

*Primary Examiner* — Tuyen T Nguyen
(74) *Attorney, Agent, or Firm* — Honigman LLP

(57) ABSTRACT

A reactor includes a coil having a wound part, a magnetic core, and a holding member holding an end face of the wound part in an axial direction and the outer core part. The holding member being a frame-shaped body having a through hole into which an end portion of the inner core part in the axial direction is inserted, the outer core part having an inward surface opposing the inner core part, an outward surface on an opposite side to the inward surface, and a plurality of peripheral surfaces joining between the inward surface and the outward surface. The reactor includes an outer retraining member pressing the outer core part against the holding member. The outer retraining member has a pressing piece pressing the outward surface of the outer core
(Continued)

part, and an engaging leg piece extending from the pressing piece and having a distal end engaging the holding member.

9 Claims, 8 Drawing Sheets

(58) Field of Classification Search
CPC ..... H01F 27/266; H01F 1/12; H01F 27/022; H01F 27/06; H01F 27/306; H01F 27/32; H01F 1/26
See application file for complete search history.

(56) References Cited

U.S. PATENT DOCUMENTS

| | | | | |
|---|---|---|---|---|
| 2016/0322150 | A1* | 11/2016 | Inaba | H01F 27/306 |
| 2018/0190421 | A1 | 7/2018 | Yoshikawa et al. | |
| 2021/0225577 | A1* | 7/2021 | Misaki | H01F 27/022 |

* cited by examiner

REACTOR

CROSS-REFERENCE TO RELATED APPLICATIONS

This application is the U.S. national stage of PCT/JP2019/019765 filed on May 17, 2019, which claims priority of Japanese Patent Application No. JP 2018-108160 filed on Jun. 5, 2018, the contents of which are incorporated herein.

TECHNICAL FIELD

The present disclosure relates to a reactor.

BACKGROUND

For example, JP 2017-55096A discloses a reactor that is provided with a coil having a wound part formed by winding a winding wire and a magnetic core forming a closed magnetic circuit, and that is utilized as a constituent component of a converter of a hybrid car or the like. The magnetic core of this reactor can be divided into an inner core part disposed inside the wound part and an outer core part disposed outside the wound part. In JP 2017-55096A, the magnetic core is formed by coupling a core piece forming the outer core part to the inner core part formed by coupling a plurality of core pieces and a gap material.

In a reactor, gaps formed between the core pieces affect the characteristics of the reactor. Thus, in the case of interposing a gap material between the core pieces, it is important to adjust the interval between the core pieces to a predetermined length, and in the case of bringing the core pieces into contact with each other, it is important to adjust the state in which the core pieces come into contact. However, with conventional configurations including JP 2017-55096A, there is a problem that this adjustment is complex. For example, in the case of coupling the core pieces together with an adhesive or the like, the interval between the core pieces must be properly maintained using a jig or the like until the adhesive solidifies. Also, in the case of integrating the core pieces with a mold resin or a potting resin, the interval between the core pieces must be properly maintained with a supporting member or the like from forming of the resin until the resin solidifies.

In view of this, one object of the present disclosure is to provide a reactor that can be produced with high productivity using a simple procedure.

Advantageous Effects of Disclosure

A reactor of the present disclosure can be produced with high productivity using a simple procedure.

SUMMARY

A reactor of the present disclosure includes a coil having a wound part and a magnetic core having an inner core part disposed inside the wound part and an outer core part disposed outside the wound part. A holding member holds an end face of the wound part in an axial direction and the outer core part, the holding member being a frame-shaped body having a through hole into which an end portion of the inner core part in the axial direction is inserted. The outer core part has an inward surface opposing the inner core part, an outward surface on an opposite side to the inward surface, and a plurality of peripheral surfaces joining between the inward surface and the outward surface, the inner core part and the holding member being engaged. The reactor further includes an outer retraining member pressing the outer core part against the holding member, the outer retraining member includes a pressing piece pressing the outward surface of the outer core part and an engaging leg piece extending from the pressing piece, and the engaging leg piece has a distal end engaging the holding member.

DETAILED DESCRIPTION OF PREFERRED EMBODIMENTS

Figure 1:
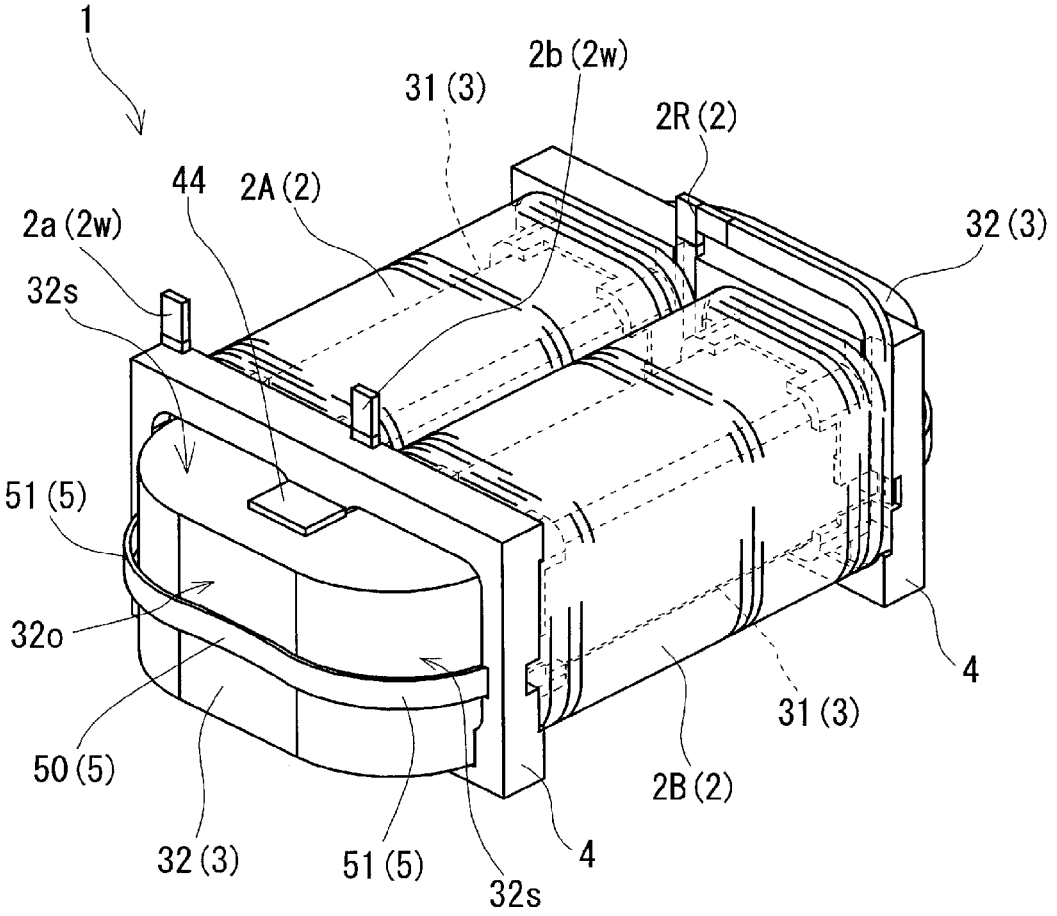
FIG. 1 is a perspective view of a reactor of a first embodiment.

Embodiments of the present disclosure will initially be enumerated and described.

A reactor of the present disclosure includes a coil having a wound part and a magnetic core having an inner core part disposed inside the wound part and an outer core part disposed outside the wound part. A holding member holds an end face of the wound part in an axial direction and the outer core part, the holding member being a frame-shaped body having a through hole into which an end portion of the inner core part in the axial direction is inserted. The outer core part has an inward surface opposing the inner core part, an outward surface on an opposite side to the inward surface, and a plurality of peripheral surfaces joining between the inward surface and the outward surface, the inner core part and the holding member being engaged. The reactor further includes an outer retraining member pressing the outer core part against the holding member, the outer retraining member includes a pressing piece pressing the outward surface of the outer core part and an engaging leg piece extending from the pressing piece, and the engaging leg piece has a distal end engaging the holding member.

In the reactor of the above configuration, the inner core part and the holding member are coupled together, and thus the inner core part can be fixed with respect to the holding member, simply by inserting the inner core part into the through hole of the holding member. Also, the outer core part can be fixed with respect to the holding member, by engaging the outer retraining member with the holding member to which the outer core part is attached. In this way, the inner core part and the outer core part can be relatively positioned simply through mechanically engagement, thus enabling the reactor of the embodiment to be produced with high productivity using a simple procedure. Naturally, the reactor of the embodiment may be molded with a resin after positioning the inner core part and the outer core part, or may be embedded in a case with a potting resin.

As one mode of the reactor according to the embodiment, the pressing piece can have a band shape, and have a portion curved so as to protrude on the outward surface side.

By curving at least a portion of the pressing piece of the outer retraining member so as to protrude on the outward surface side of the outer core part, the pressing piece functions as a leaf spring. As a result, the pressing force applied to the outer core part by the outer retraining member can be increased.

As one mode of the reactor according to the embodiment, the pressing piece can have a band shape, and the engaging leg piece can extend from one end and another end of the pressing piece in an extending direction, and have a shape following a shape of the peripheral surface.

By forming the engaging leg piece to have a shape following the peripheral surface of the outer core part, a large gap tends not to occur between the peripheral surface of the outer core part and the engaging leg piece. As a result, the outer retraining member can be inhibited from being knocked off due to an object or a finger catching on the engaging leg piece when handling the reactor.

As one mode of the reactor according to the embodiment, the outer core part and the inner core part can each be an integrated part having an undivided structure.

Because the number of components constituting the magnetic core decreases if the outer core part and the inner core part are both integrated parts having an undivided structure, the man-hours involved in assembling the reactor can be reduced. Thus, the productivity of the reactor can be improved.

As one mode of the reactor described above, the reactor can include: a peripheral surface engaging part formed on a peripheral surface of the inner core part; and a hole-side engaging part formed on an inner peripheral surface of the through hole of the holding member, the peripheral surface engaging part can be a raised portion protruding outwardly of the inner core part, and the hole-side engaging part can be a recessed portion recessed outwardly of the through hole, and in which the raised portion is fitted.

By constituting the peripheral surface engaging part as a raised part, the peripheral surface engaging part can be formed without reducing the magnetic circuit cross-sectional area of the inner core part.

As one mode of the reactor described above, the reactor can include: a peripheral surface engaging part formed on a peripheral surface of the inner core part; and a hole-side engaging part formed on an inner peripheral surface of the through hole of the holding member, the peripheral surface engaging part can be a recessed portion recessed inwardly of the inner core part, and the hole-side engaging part can be a raised portion protruding inwardly of the through hole and fitted in the recessed portion.

The inner core part is constituted by a molded body of a composite material including a soft magnetic powder and a resin, or a compacted powder molded body formed by compression molding a soft magnetic powder. With these molded bodies produced using a mold, forming a peripheral surface engaging part constituted by a recessed portion is easier than forming a peripheral surface engaging part constituted by a raised part. This is because the recessed portion can also be formed by machining after forming the inner core part.

As one mode of the reactor of the above, the peripheral surface engaging part can be a circumferential groove formed around the peripheral surface of the inner core part.

Because stress that occurs at the time of engaging the inner core part and the holding member can be distributed around the peripheral surface of the inner core part if the recessed portion forming the peripheral surface engaging part is a circumferential groove, the inner core part is readily inhibited from being damaged at the time of engagement. Here, the raised part (hole-side engaging part) that engages the circumferential groove may be a circumferential protrusion that engages the entire circumference of the circumferential groove, but is preferably a plurality of separate protrusions that discontinuously engage the circumferential groove in the circumferential direction. This is because each separate protrusion is short and readily deformable compared with one long circumferential protrusion, and thus engagement of the inner core part and the holding member is facilitated.

As one mode of the reactor according to the embodiment, the end face of the inner core part in the axial direction can abut the inward surface of the outer core part.

When the inner core part and the outer core part are separated, magnetic flux tends to leak from between the separated core parts. In contrast, if the inner core part abuts the outer core part, as shown in the above configuration, leaking of magnetic flux from the boundary position between the inner core part and the outer core part can be inhibited, thus enabling a low loss reactor to be realized.

As one mode of the reactor according to the embodiment, at least the peripheral surface of the inner core part can be constituted by a molded body of a composite material including a soft magnetic powder and a resin.

A molded body of a composite material has greater flexibility in terms of shape than a compacted powder molded body formed by compression molding a soft magnetic powder. Thus, formation of the recessed portion or the raised part constituting the peripheral surface engaging part of the inner core part is facilitated.

Hereinafter, embodiments of a reactor of the present disclosure will be described based on the drawings. The same reference numerals in the drawings indicate elements of the same name. Note that the present disclosure is not limited to the configurations shown in the embodiments and is defined by the claims, and all changes that come within the meaning and range of equivalency of the claims are intended to be embraced therein.

First Embodiment

A first embodiment describes the configuration of a reactor 1 based on FIG. 1, FIG. 2, FIG. 3A, and FIG. 3B. The reactor 1 shown in FIG. 1 is constituted by assembling together a coil 2, a magnetic core 3, and a holding member 4. The magnetic core 3 is provided with an inner core part 31 and an outer core part 32. One of the features of this reactor 1 is having a configuration that mechanically engages the inner core part 31 and the holding member 4 and a configuration that mechanically engages the outer core part 32 and the holding member 4. Hereinafter, each member provided in the reactor 1 will be described, followed by a detailed description of each engagement mechanism.

Coil

The coil 2 of the present embodiment is provided with a pair of wound parts 2A and 2B and a coupling part 2R that couples the wound parts 2A and 2B together, as shown in FIG. 1. The wound parts 2A and 2B are each formed in a hollow tubular shape with the same number of turns and the same winding direction, and are aligned such that respective axial directions are parallel. In the present example, the coil 2 is manufactured by coupling the wound parts 2A and 2B produced using separate winding wires 2*w*, but the coil 2 can also be manufactured with a single winding wire 2*w*.

The wound parts 2A and 2B of the present embodiment are formed in a square-tubular shape. The square-tubular wound parts 2A and 2B are wound parts whose end face shape is a four-cornered shape (including a square shape) with rounded corners. Naturally, the wound parts 2A and 2B may be cylindrically formed. Cylindrical wound parts are wound parts whose end face shape is a closed curved shape (an elliptical shape, a perfectly round shape, a racetrack shape, etc.).

The coil 2 including the wound parts 2A and 2B can be constituted by a covered wire provided with an insulated covering made from an insulating material on an outer periphery of a conductor such as a flat wire or a round wire made from a conductive material such as copper, aluminum and magnesium or an alloy thereof. In the present embodiment, the wound parts 2A and 2B are formed by edgewise winding a covered flat wire whose conductor is made from a copper flat wire (winding wire 2*w*) and whose insulated covering is made from an enamel (typically, polyamide imide).

Both end portions 2*a* and 2*b* of the coil 2 extend from the wound parts 2A and 2B, and are connected to a terminal member which is not illustrated. At both end portions 2*a* and 2*b*, the insulated covering of an enamel or the like has been removed. Connection of an external device such as a power source that performs power supply to the coil 2 is established via this terminal member.

Magnetic Core

The magnetic core 3 is provided with inner core parts 31 and 31 respectively disposed inside the wound part 2A and the wound part 2B, and outer core parts 32 and 32 forming a closed magnetic circuit with these inner core parts 31 and 31.

Inner Core Part

The inner core part 31 is a portion of the magnetic core 3 that extends in the axial direction of the wound parts 2A and 2B of the coil 2. In the present example, both end portions of the portion of the magnetic core 3 that extends in the axial direction of the wound parts 2A and 2B protrude from the end faces of the wound parts 2A and 2B. These protruding portions are also a portion of the inner core part 31. The end portions of the inner core part 31 that protrude from the wound parts 2A and 2B are inserted into a through hole 40 (FIG. 2, FIG. 3A, FIG. 3B) of the holding member 4 which will be described later.

Figure 2:
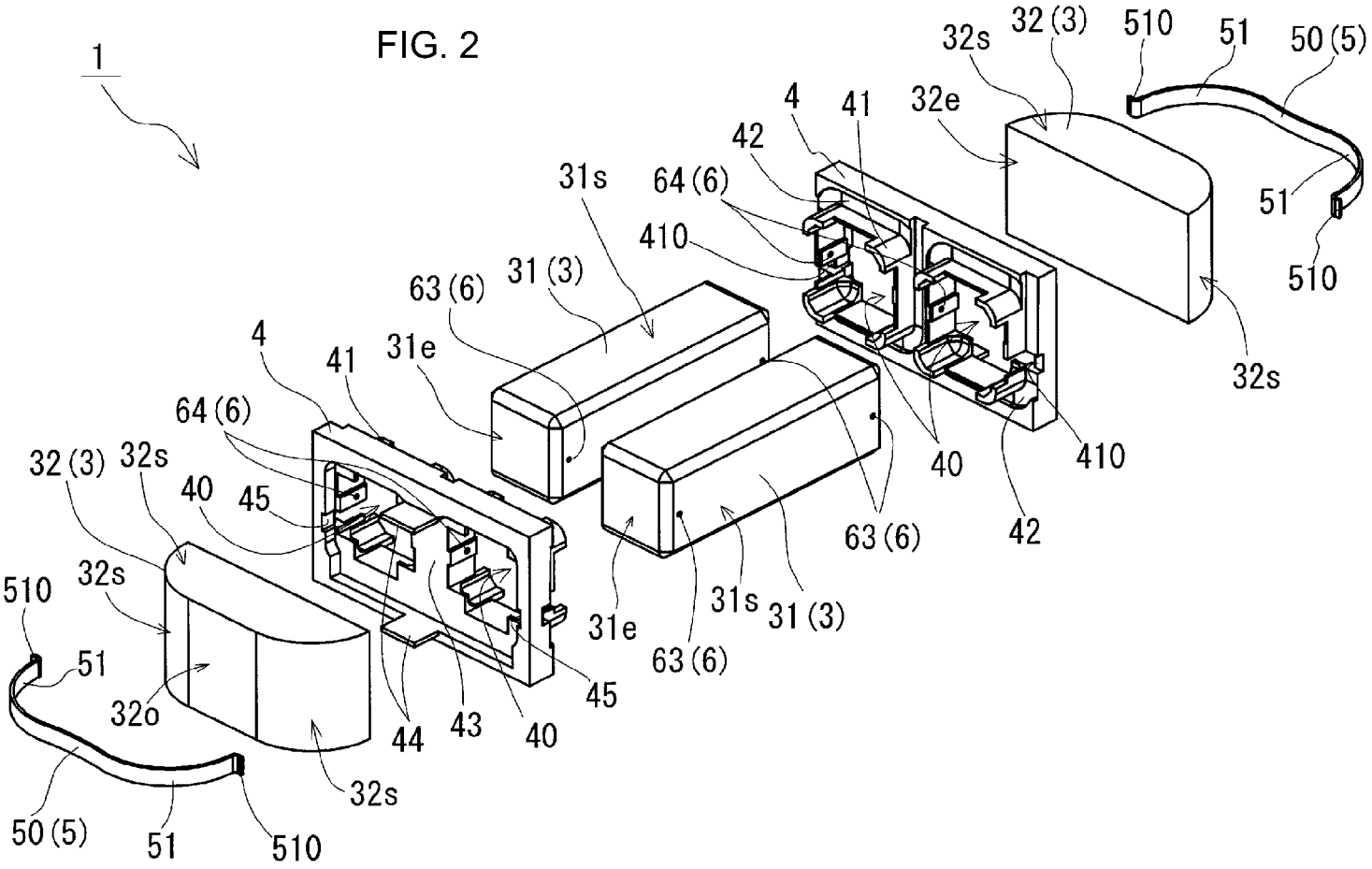
FIG. 2 is an exploded perspective view of the reactor of FIG. 1 excluding a coil.

The shape of the inner core part 31 is not particularly limited as long as the shape follows the internal shape of the wound part 2A (2B). The inner core part 31 of the present example is an approximately rectangular parallelepiped as shown in FIG. 2. The inner core part 31 is an integrated part having an undivided structure, this being one of the factors facilitating assembly of the reactor 1. Alternatively to the present example, the inner core part 31 can also be constituted by assembling together a plurality of divided pieces. A gap plate made with alumina or the like can be interposed between the divided pieces.

An end face 31*e* of the inner core part 31 in the axial direction abuts an inward surface 32*e* (FIG. 2, FIG. 3A, FIG. 3B) of the outer core part 32 which will be described later. An adhesive may be interposed between the end face 31*e* and the inward surface 32*e*, but is not necessary. As will be described later, this is because the inner core part 31 is positioned by being mechanically fixed to the holding member 4, and, furthermore, because the outer core part 32 is pressed toward the holding member 4.

The inner core part 31 of the present example is, furthermore, provided with a peripheral surface engaging part 63 that is formed on a peripheral surface 31*s* thereof. The peripheral surface engaging part 63 of the present example is a recessed part formed by a portion of the inner core part 31 being inwardly recessed, and constitutes a portion of a mutual engaging part 6 which will be described later (see FIG. 3B in particular).

Outer Core Part

The outer core part 32 is a portion of the magnetic core 3 that is disposed outside the wound parts 2A and 2B (FIG. 1). The shape of the outer core part 32 is not particularly limited as long as the shape joins the end portions of the pair of inner core parts 31 and 31. The outer core part 32 of the present example is a block body whose upper surface and lower surface are approximately dome-shaped. Each outer core part 32 has the inward surface 32*e* opposing the end faces of the wound parts 2A and 2B of the coil 2, an outward surface 32*o* on the opposite side to the inward surface 32*e*, and a peripheral surface 32*s*, as shown in FIGS. 2 and 3. The inward surface 32*e* and the outward surface 32*o* are flat surfaces parallel to each other. An upper surface and a lower surface of the peripheral surface 32*s* are flat surfaces that are parallel to each other and orthogonal to the inward surface 32*e* and the outward surface 32*o*. Also, two side surfaces of the peripheral surface 32*s* are curve surfaces.

Materials, Etc.

The inner core part 31 and the outer core part 32 can be constituted by a compacted powder molded body formed by compression molding a base powder including a soft magnetic powder, or a molded body made from a composite material of a soft magnetic powder and a resin. In addition, both core parts 31 and 32 can also be constituted as a hybrid core in which the outer periphery of a compacted powder molded body is covered with a composite material.

The compacted powder molded body can be produced by filling a mold with a base powder and applying pressure thereto. Due to this production method, the content of soft magnetic powder in the compacted powder molded body can be readily increased. For example, the content of soft magnetic powder in the compacted powder molded body can be increased to over 80 volume %, and, furthermore, to 85 volume % or more. Thus, in the case of a compacted powder molded body, core parts 31 and 32 whose saturation magnetic flux density and relative permeability are high are readily obtained. For example, the relative permeability ratio of the compacted powder molded body can be set to from 50 to 500 inclusive, and, furthermore, from 200 to 500 inclusive.

The soft magnetic powder of the compacted powder molded body is an aggregate of soft magnetic particles that are constituted by an iron group metal such as iron, an alloy thereof (Fe—Si alloy, Fe—Ni alloy, etc.), or the like. An insulated covering that is constituted by a phosphate or the like may be formed on the surface of the soft magnetic particles. Also, the base powder may contain a lubricant or the like.

On the other hand, the molded body of a composite material can be produced by filling a mold with a mixture of a soft magnetic powder and an uncured resin, and curing the resin. Due to this production method, the content of the soft magnetic powder in the composite material can be readily adjusted. For example, the content of the soft magnetic powder in the composite material can set to from 30 volume % to 80 volume % inclusive. From the viewpoint of improving saturation magnetic flux density and heat dissipation, the content of the magnetic powder is, furthermore, preferably 50 volume % or more, 60 volume % or more, and 70 volume % or more. Also, from the viewpoint of improving fluidity in the manufacturing process, the content of the magnetic powder is preferably set to 75 volume % or less. With the molded body of a composite material, the relative permeability thereof is readily reduced by adjusting the filling rate of the soft magnetic powder to a lower rate. For example, the relative permeability of the molded body of a composite material can be set to from 5 to 50 inclusive, and, furthermore, from 20 to 50 inclusive.

The same material that can be used with the compacted powder molded body can be used for the soft magnetic powder of the composite material. On the other hand, a thermosetting resin, a thermoplastic resin, a room-temperature curing resin and a cold curing resin are given as examples of the resin contained in the composite material. An unsaturated polyester resin, an epoxy resin, a urethane resin and a silicone resin are given as examples of the thermosetting resin. A polyphenylene sulphide (PPS) resin, a polytetrafluoroethylene (PTFE) resin, a liquid crystal polymer (LP), a polyamide (PA) resin such as nylon 6 or nylon 66, a polybutylene terephthalate (PBT) resin and an acrylonitrile butadiene styrene (ABS) resin are given as examples of the thermoplastic resin. In addition, a millable silicone rubber, a millable urethane rubber, a BMC (Bulk molding compound) in which calcium carbonate or glass fiber is mixed with an unsaturated polyester and the like can also be utilized. Heat dissipation is further improved when the abovementioned composite material contains a nonmagnetic and nonmetallic powder (filler) such as alumina or silica, in addition to the soft magnetic powder and the resin. The content of the nonmagnetic and nonmetallic powder may be from 0.2 mass % to 20 mass % inclusive, and, furthermore, from 0.3 mass % to 15 mass % inclusive, and from 0.5 mass % to 10 mass % inclusive.

Here, in order to form the peripheral surface engaging part 63 on the peripheral surface 31*s* of the inner core part 31, it is preferable that at least the peripheral surface 31*s* is formed with a molded body of a composite material. This is because a molded body of a composite material has greater flexibility in terms of shape than a compacted powder molded body which has restrictions on the direction in which pressure is applied at the time of molding, and thus formation of the peripheral surface engaging part 63 is facilitated. In the case of constituting the inner core part 31 as a hybrid core, the compacted powder molded body need only be disposed in a mold and a composite material injected into the mold.

Holding Member

Figure 3A:
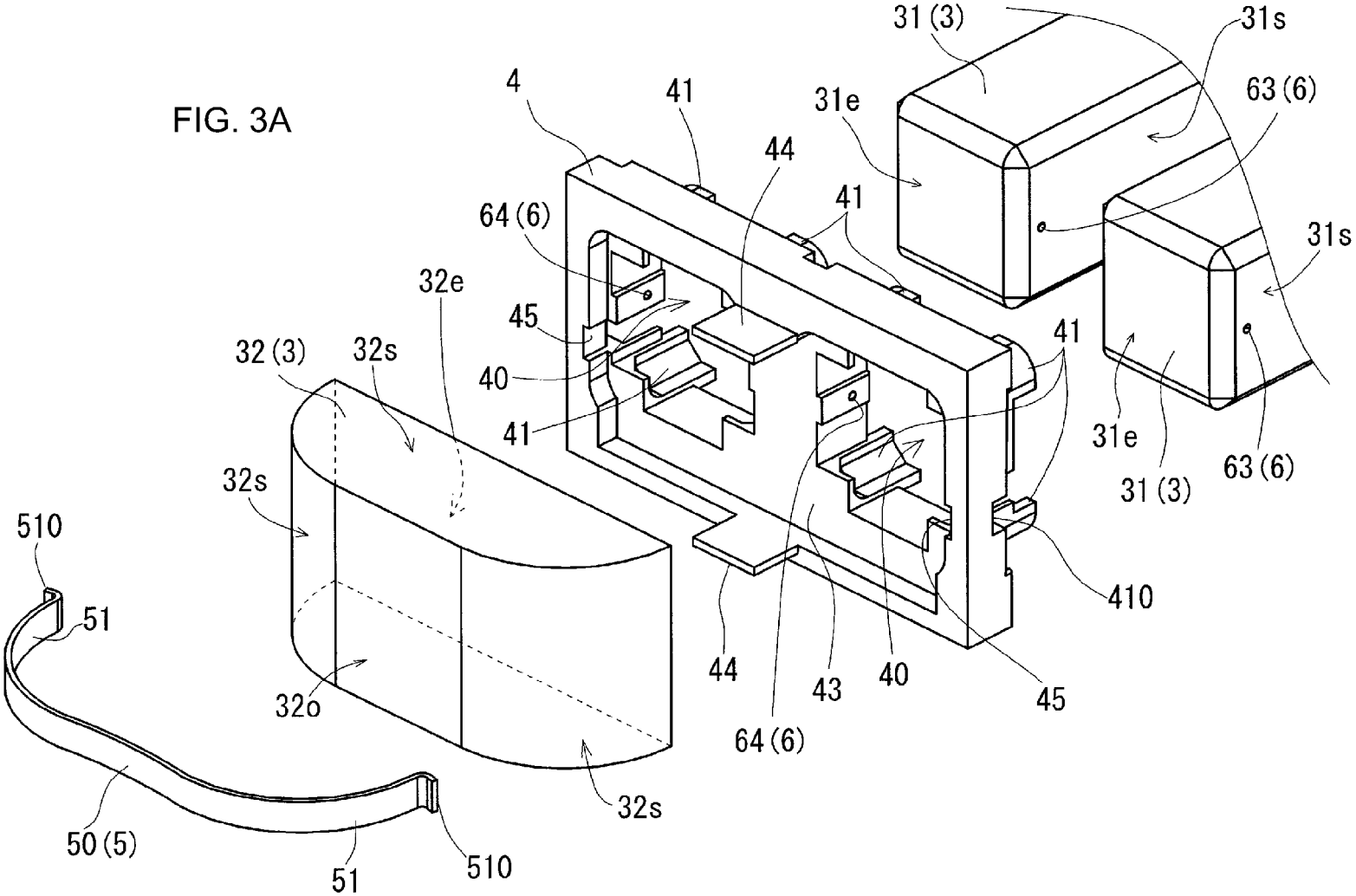
FIG. 3A is partial enlarged view illustrating an engaged state of an outer core part and a holding member and an engaged state of the holding member and an inner core part in the reactor of the first embodiment.

The holding member 4 shown in FIG. 2 and FIG. 3A is a member that is interposed between the end faces of the wound parts 2A and 2B (FIG. 1) of the coil 2 and the inward surface 32*e* of the outer core part 32 of the magnetic core 3, and holds the end faces of the wound parts 2A and 2B in the axial direction and the outer core part 32. The holding member 4, typically, is constituted by an insulating material, and functions as an insulating member between the coil 2 and the magnetic core 3 and a positioning member of the inner core part 31 and the outer core part 32 with respect to the wound parts 2A and 2B. The two holding members 4 of the present example have the same shape. Thus, since the mold for producing the holding member 4 can be commonly used, excellent productivity of the holding member 4 is achieved.

The holding member 4 is provided with a pair of through holes 40 and 40, a plurality of core supporting parts 41, a pair of coil housing parts 42 (FIG. 2), one core housing part 43, and a pair of restraining parts 44. The through hole 40 passes through the holding member 4 in the thickness direction, and the end portion of the inner core part 31 is inserted into this through hole 40. The core supporting part 41 is an arc-shaped piece that partially protrudes from the inner peripheral surface of each through hole 40, and supports a corner portion of the inner core part 31. The coil housing part 42 (FIG. 2) is a recess that follows the end faces of the wound parts 2A and 2B (FIG. 1), and the end faces and a vicinity thereof are fitted therein. The core housing part 43 is formed by a portion of the surface of the holding member 4 on the outer core part 32 side being recessed in the thickness direction, and the inward surface 32*e* of the outer core part 32 and a vicinity thereof are fitted therein (see also FIG. 1). The end face 31*e* of the inner core part 31 fitted in the through hole 40 of the holding member 4 is substantially flush with the bottom surface of the core housing part 43. Thus, the end face 31*e* of the inner core part 31 abuts the inward surface 32*e* of the outer core part 32. An upward restraining part 44 and a downward restraining part 44 respectively restrain the upper surface and the lower surface of the outer core part 32 fitted in the core housing part 43.

The holding member 4 can, for example, be constituted by a thermoplastic resin such as a polyphenylene sulphide (PPS) resin, a polytetrafluoroethylene (PTFE) resin, a liquid crystal polymer (LP), a polyamide (PA) resin such as nylon 6 or nylon 66, a polybutylene terephthalate (PBT) resin, or an acrylonitrile butadiene styrene (ABS) resin. In addition, the holding member 4 can be formed with a thermosetting resin such as an unsaturated polyester resin, an epoxy resin, a urethane resin or a silicone resin. Heat dissipation of the holding member 4 may be improved by including a ceramic filler in these resins. A nonmagnetic powder such as alumina or silica, for example, can be utilized as the ceramic filler.

Configuration for Engaging Inner Core Part and Holding Member

The reactor 1 of the present example has a configuration (hereinafter, mutual engaging part 6) that mechanically engages the inner core part 31 and the holding member 4. The mutual engaging part 6 is constituted by a peripheral surface engaging part 63 that is formed on the peripheral surface 31*s* of the inner core part 31, and a hole-side engaging part 64 formed on the inner peripheral surface of the through hole 40 of the holding member 4.

The peripheral surface engaging part 63 of the present example is provided one on each of two side surfaces of the peripheral surface 31*s* of the inner core part 31 oriented in the alignment direction of the pair of wound parts 2A and 2B (FIG. 1). Naturally, the number of peripheral surface engaging parts 63 is not limited, and the position thereof is also not particularly limited as long as the disposition location is on the peripheral surface 31*s* inside the through hole 40. On the other hand, the number and position of the hole-side engaging part 64 in the present example corresponds to the number and position of the peripheral surface engaging parts 63.

Figure 3B:
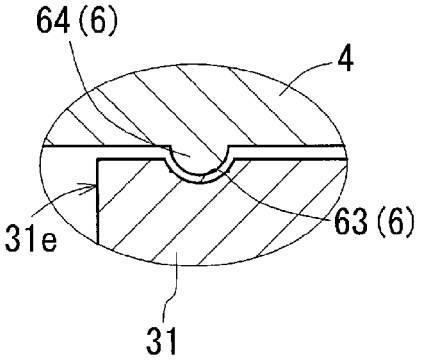
FIG. 3B is a partial cross-sectional view of a vicinity of a mutual engaging part in the reactor of the first embodiment.

The peripheral surface engaging part 63 of the present example is a recessed portion recessed inwardly of the inner core part 31, as shown in FIG. 3B. On the other hand, the hole-side engaging part 64 is a raised portion that protrudes inwardly of the through hole 40, and is fitted in the peripheral surface engaging part 63 (recessed portion). The inner peripheral surface shape of the recessed portion preferably follows the outer peripheral surface shape of the raised portion, and, by adopting this configuration, fitting of the raised portion in the recessed portion is facilitated, and the raised portion does not readily disengage from the recessed portion.

The opening shape of the peripheral surface engaging part 63 (recessed portion) is not particularly limited, and may, for example, be polygonal including round, elliptical and rectangular. On the other hand, the depth of the peripheral surface engaging part 63 (recessed portion) is preferably set in a predetermined range. When the recessed portion is too deep, the protruding length of the raised portion corresponding to the recessed portion increases, and there is a risk that the raised portion or the peripheral surface 31*s* of the inner core part 31 may be damaged when the inner core part 31 is inserted into the through hole 40, and when the recessed portion is too shallow, there is a risk that the engaging force of the recessed portion and the raised portion may decrease. In view of this, the depth of the recessed portion is preferably set to from 0.2 mm to 5 mm inclusive, and more preferably from 0.5 mm to 1 mm inclusive. The range of the height of the raised portion corresponding to the recessed portion is also preferably set in the same range as the preferable depth of the recessed portion.

The recessed portion preferably gradually narrows in the depth direction. The raised portion corresponding to the recessed portion also preferably gradually narrows in the height direction. By adopting this configuration, the insertability of the inner core part 31 into the through hole 40 can be improved, and the raised portion can be readily inhibited from being damaged at the time of the insertion. In the present example, the raised portion is hemispherical, and the inner peripheral surface of the recessed portion is also approximately hemispherical.

According to the mutual engaging part 6 described above, the inner core part 31 is fixed with respect to the holding member 4, simply by inserting the inner core part 31 into the through hole 40 of the holding member 4.

Configuration for Engaging Outer Core Part and Holding Member

The reactor 1 of the present example is provided with an outer retraining member 5 that presses the outer core part 32 against the holding member 4, as a configuration for mechanically engaging the outer core part 32 and the holding member 4.

The outer retraining member 5 of the present example has a pressing piece 50 that presses on the outward surface 32*o* of the outer core part 32, and a pair of engaging leg pieces 51 that extend from the pressing piece 50 and whose distal end engages a portion of the holding member 4. The pressing piece 50 of the present example is formed in a band shape, and curves so as to be raised toward the outward surface 32*o*. In the present example, the whole of the pressing piece 50 is curved, but a portion of the pressing piece 50 may be curved. In this way, by curving at least a portion of the pressing piece 50 so as to protrude on the outward surface 32*o* side, the pressing piece 50 functions as a leaf spring. As a result, the pressing force exerted on the outer core part 32 by the outer retraining member 5 can be increased.

The engaging leg pieces 51 of the outer retraining member 5 respectively extend from one end and the other end of the pressing piece 50 in the extending direction. The engaging leg piece 51 is also formed in a band shape, and curves following the shape of the peripheral surface 32*s* (curved side surface) of the outer core part 32. By forming the engaging leg piece 51 to have a shape following the peripheral surface 32*s* of the outer core part 32, a large gap tends not to occur between the peripheral surface 32*s* and the engaging leg piece 51. As a result, the outer retraining member 5 can be inhibited from being knocked off due to an object or a finger catching on the engaging leg piece 51 when handing the reactor 1.

A restraining-side engaging part 510 is formed at one end portion and the other end portion of the engaging leg pieces 51. The pair of restraining-side engaging parts 510 of the present example are formed by being bent in a direction away from each other. This bending direction coincides with a direction away from the wound parts 2A and 2B, among the alignment directions of the wound parts 2A and 2B.

This restraining-side engaging part 510 have a function of fixing the outer retraining member 5 to the holding member 4, by engaging a frame-side engaging part 410 of the holding member 4. The frame-side engaging part 410 is formed by a portion of the coil housing part 42 being recessed in the thickness direction, as shown in the holding member 4 on the far side of the page in FIG. 2. This frame-side engaging part 410 is joined to a notch part 45 formed by notching the side wall of the core housing part 43 shown in FIG. 3A in a sideward direction. Due to the notch part 45 being provided, an insertion hole that passes through the holding member 4 in the thickness direction is formed between the lateral peripheral surface 32*s* of the outer core part 32 and the notch part 45, when the outer core part 32 is fitted in the core housing part 43 of the holding member 4. If the end portion of the engaging leg piece 51 of the outer retraining member 5 is inserted into this insertion hole, the restraining-side engaging part 510 of the engaging leg piece 51 catches on the frame-side engaging part 410, and the outer retraining member 5 is fixed to the holding member 4. The pressing piece 50 of the outer retraining member 5 fixed to the holding member 4 then presses on the outward surface 32*o* of the outer core part 32 and the outer core part 32 is pressed against the holding member 4. As a result, the outer core part 32 mechanically engages the holding member 4. The inner surface 32*e* of the outer core part 32 contacts the end face 31*e* of the inner core part 31.

Use Mode

The reactor 1 of the present example can be utilized as a constituent member of a power conversion device such as a bidirectional DC-DC converter mounted in an electrically powered vehicle such as a hybrid car, an electric car or a fuel cell vehicle. The reactor 1 of the present example can be used in a state of being immersed in a liquid refrigerant. The liquid refrigerant is not particularly limited, and ATF (Automatic Transmission Fluid) or the like can be utilized as the liquid refrigerant, in the case of utilizing the reactor 1 with a hybrid car. In addition, a fluorinated inert liquid such as Fluorinert (registered trademark), a fluorocarbon refrigerant such as HCFC-123 or HFC-134a, an alcohol refrigerant such as methanol or alcohol, a ketone refrigerant such as acetone or the like can also be utilized as the liquid refrigerant. In the reactor 1 of the present example, since the wound parts 2A and 2B are externally exposed, the wound parts 2A and 2B are brought in direct contact with the cooling medium in the case of cooling the reactor 1 with a cooling medium such as a liquid refrigerant, and thus the reactor 1 of the present example exhibits excellent heat dissipation.

Effects

In the reactor 1 of the present example, the inner core part 31 can be fixed with respect to the holding member 4 by the mutual engaging part 6, simply by inserting the inner core part 31 into the through hole 40 of the holding member 4. Also, the outer core part 32 can be fixed with respect to the holding member 4, by engaging the outer retraining member 5 with the holding member 4 to which the outer core part 32 is attached. In this way, the inner core part 31 and the outer core part 32 can be relatively positioned simply through mechanically engagement, thus enabling the reactor 1 of the present embodiment to be produced with high productivity using a simple procedure. Naturally, the reactor 1 of the present embodiment may be molded with a resin after positioning the inner core part 31 and the outer core part 32, or may be embedded in a case with a potting resin.

Second Embodiment

A reactor in which the configuration of the mutual engaging part and the outer retraining member differs from the first embodiment will be described based on FIG. 4A and FIG. 4B.

Mutual Engaging Part

Figure 4A:
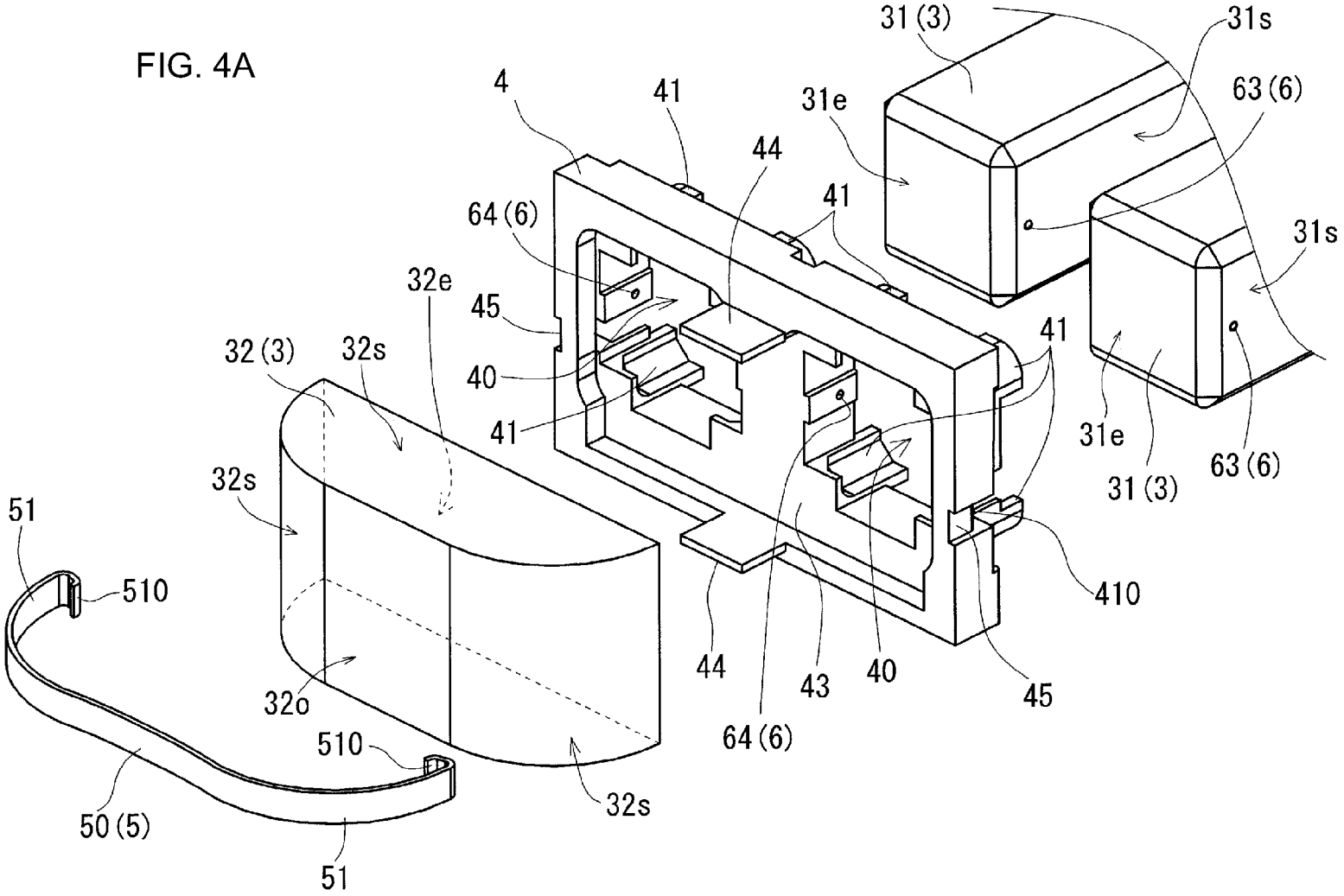
FIG. 4A is a partial enlarged view illustrating an engaged state of an outer core part and a holding member and an engaged state of the holding member and an inner core part in a reactor of a second embodiment.
Figure 4B:
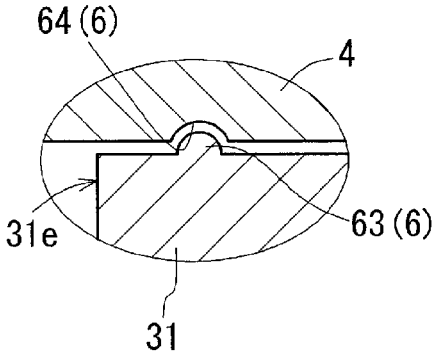
FIG. 4B is a partial cross-sectional view of a vicinity of a mutual engaging part in the reactor of the second embodiment.

In the mutual engaging part 6 of the present example, the peripheral surface engaging part 63 is a raised portion and the hole-side engaging part 64 is a recessed portion, as shown in FIG. 4B. The number and position of the recessed portions and raised portions and the shape thereof can be selected similarly to the first embodiment. By constituting the peripheral surface engaging part 63 with a raised portion, the peripheral surface engaging part 63 can be formed without decreasing the magnetic circuit cross-sectional area of the inner core part 31.

Outer Retraining Member

As shown in FIG. 4A, the restraining-side engaging part 510 of the outer retraining member 5 in the present example is bent in the opposite direction to the first embodiment. That is, the pair of restraining-side engaging parts 510 are bent in a direction approaching each other. The frame-side engaging part 410 that engages this restraining-side engaging part 510 is formed in the coil housing part 42 (refer to FIG. 2), similarly to the first embodiment. The notch part 45 that is joined to the frame-side engaging part 410 is, however, formed in the side edge of the holding member 4, different from the first embodiment.

Figure 5A:
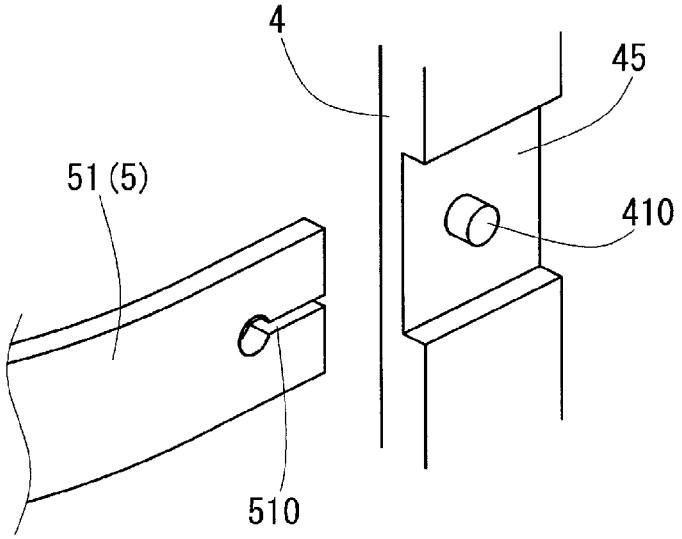
FIG. 5A is a schematic view showing a configuration of a different outer retraining member from FIG. 4A.

Here, the configuration of the outer retraining member 5 is not particularly be limited as long as the outer retraining member 5 can be firmly fixed to the holding member 4. For example, modes such as exemplified in FIG. 5A and FIG. 5B may be employed. In the configuration in FIG. 5A, the restraining-side engaging part 510 is configured by a slit that is cut inwardly from the end face of the engaging leg piece 51 and a fastening hole that is formed in an innermost portion of the slit and passes through the engaging leg piece 51 in the thickness direction. On the other hand, the frame-side engaging part 410 is constituted by a protrusion that is formed on a bottom portion of the notch part 45. The outer diameter of the protrusion is slightly smaller than the inner diameter of the fastening hole, and larger than the width of the slit. Thus, if the engaging leg piece 51 is pushed onto the frame-side engaging part 410, the slit is pushed apart by the frame-side engaging part 410, and the outer retraining member 5 is fixed to the holding member 4 due to the frame-side engaging part 410 fitting in the fastening hole.

Figure 5B:
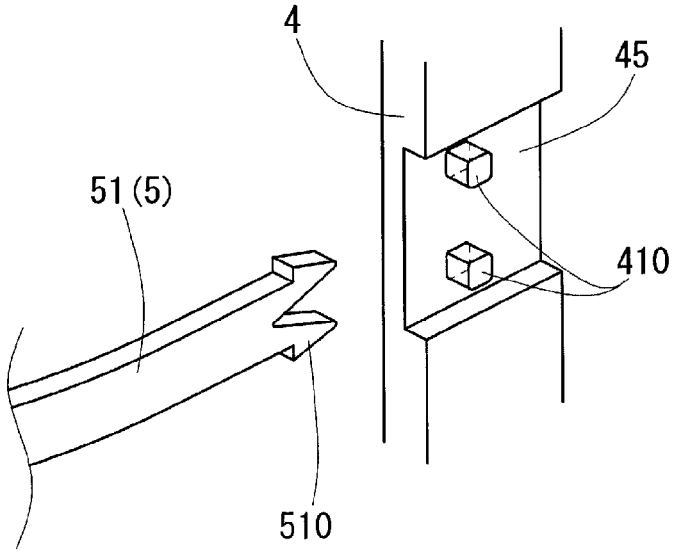
FIG. 5B is a schematic view showing the configuration of a different outer retraining member from FIG. 4A and FIG. 5A.

In the configuration in FIG. 5B, the restraining-side engaging part 510 is constituted from by a forked claw portion. On the other hand, the frame-side engaging part 410 is constituted by a pair of protrusions formed on a bottom portion of the notch part 45. The two protrusions are separated by a distance that is slightly larger than the width (length in the up-down direction on the page) of the engaging leg piece 51, and smaller than the distance between the outer end portions (stepped portions) of both claw portions in the alignment direction. Thus, if the engaging leg piece 51 is pushed onto the frame-side engaging part 410, the interval between the two claw portions narrows, and the outer retraining member 5 is fixed to the holding member 4, due to the interval between both claw portions widening and the stepped portions of the claw portions catching on the protrusions (frame-side engaging parts 410) when the outer end portions of the claw portions pass the position of the protrusions.

Third Embodiment

Figure 6:
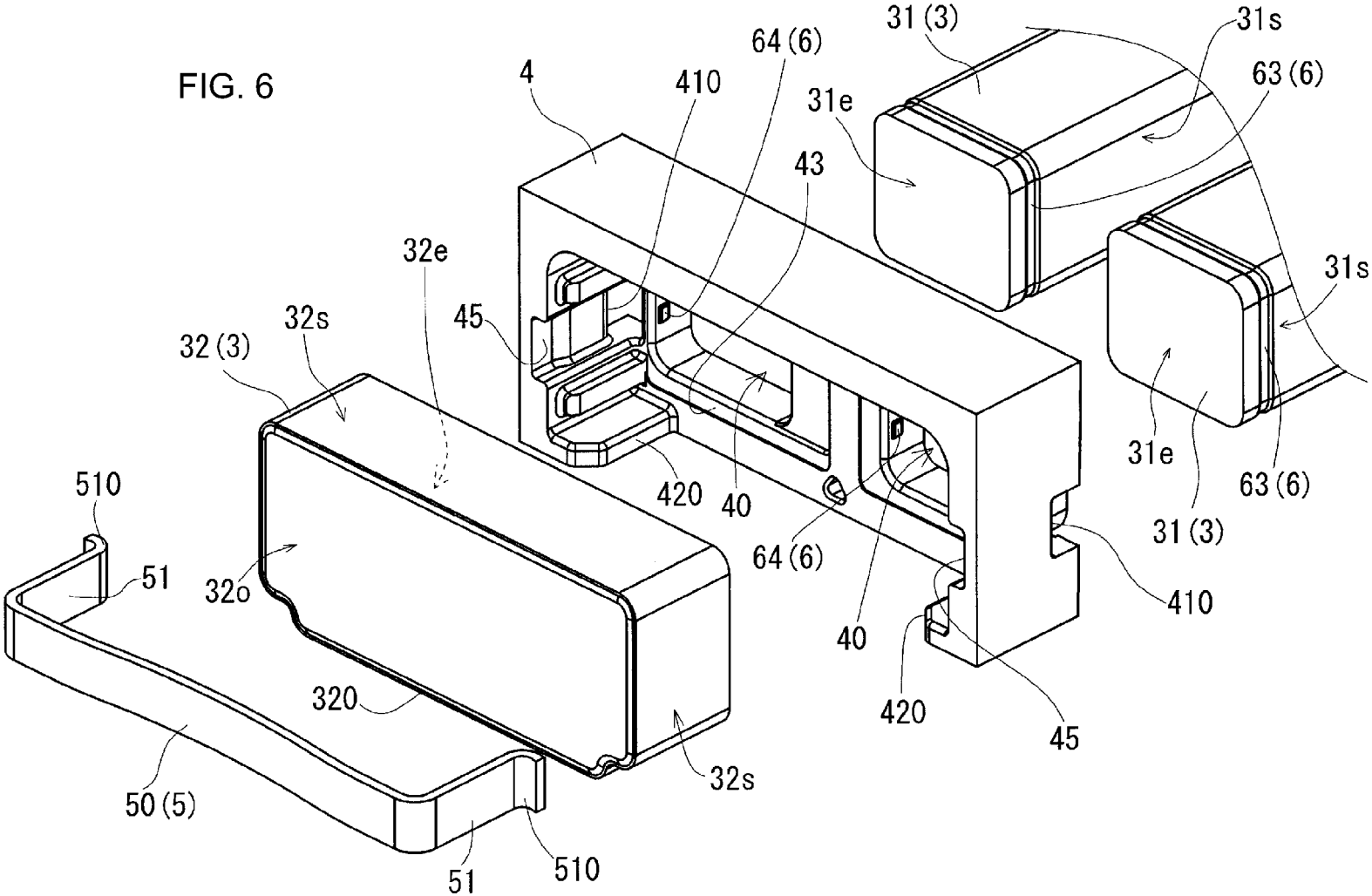
FIG. 6 is a partial enlarged view illustrating an engaged state of an outer core part and a holding member and an engaged state of the holding member and an inner core part in a reactor of a third embodiment.

In a third embodiment, a reactor whose configuration of the mutual engaging part 6 differs from the first and second embodiments will be described based on FIG. 6.

The peripheral surface engaging part 63 of the mutual engaging part 6 in the present example is a circumferential groove that is formed around the peripheral surface 31*s* of the inner core part 31. By configuring the peripheral surface engaging part 63 as a circumferential groove, stress that occurs at the time of engaging the inner core part 31 and the holding member 4 can be distributed around the peripheral surface of the inner core part 31, and thus the inner core part 31 is readily inhibited from being damaged at the time of engagement. On the other hand, the raised portion (hole-side engaging part 64) that engages this circumferential groove is constituted by a plurality of separate protrusions that discontinuously engage the circumferential groove in the circumferential direction. Each separate protrusion is short and readily deformable, thus facilitating engagement of the inner core part 31 and the holding member 4, and the inner core part 31 is also less likely to be damaged.

In addition, in the present example, a portion of a lower piece of the holding member 4 that opposes an installation surface of a cooling base or the like is notched. The remaining portion (overhanging lower piece 420) of the lower piece excluding the notched portion is joined to a left piece and a right piece of the holding member 4. The outer core part 32 that is fitted in the core housing part 43 of this holding member 4 is provided with a downward protruding part 320 disposed in the notch formed between the left and right overhanging lower pieces 420. With such a configuration, a stepped portion of the outer core part 32 that is wider than the downward protruding part 320 engages the overhanging lower pieces 420, when the outer core part 32 is fitted in the core housing part 43 of the holding member 4, and thus the outer core part 32 does not drop downward. According to this configuration, the magnetic circuit cross-sectional area of the outer core part 32 can be enlarged, and the lower surface of the downward protruding part 320 of the outer core part 32 can be brought into contact with an installation surface of a cooling base or the like, thus enabling heat dissipation of the reactor 1 to be improved.

Fourth Embodiment

In the first to third embodiments, the outer retraining member 5 is attached sideways around the outward surface 32*o* and the leftward and rightward peripheral surfaces 32*s* of the outer core part 32. In contrast, a configuration may be adopted in which the outer retraining member 5 is attached vertically around the outward surface 32*o* and the upward and downward peripheral surfaces 32*s*.

Fifth Embodiment

The respective configurations of the first to fourth embodiments may be combined as appropriate. For example, the mutual engaging part 6 of the first embodiment and the outer retraining member 5 of the second embodiment may be combined, and the outer core part 32 having the shape of the third embodiment may be further combined with this combined configuration.

The invention claimed is:

1. A reactor comprising:

a coil having a wound part;

a magnetic core having an inner core part disposed inside the wound part and an outer core part disposed outside the wound part; and a holding member holding an end face of the wound part in an axial direction and the outer core part, wherein the holding member is a frame-shaped body having a through hole into which an end portion of the inner core part in the axial direction is inserted, the outer core part has an inward surface opposing the inner core part, an outward surface on an opposite side to the inward surface, and a plurality of peripheral surfaces joining between the inward surface and the outward surface, and the inner core part and the holding member are engaged, the reactor comprising an outer retraining member pressing the outer core part against the holding member, wherein the outer retraining member has:

a pressing piece pressing the outward surface of the outer core part; and an engaging leg piece extending from the pressing piece, and the engaging leg piece has a distal end engaging the holding member.

2. The reactor according to claim 1, wherein the pressing piece has a band shape, and has a portion curved so as to protrude on the outward surface side.

3. The reactor according to claim 1, wherein the pressing piece has a band shape, and the engaging leg piece extends from one end and another end of the pressing piece in an extending direction, and has a shape following a shape of the peripheral surface.

4. The reactor according to claim 1, wherein the outer core part and the inner core part are each an integrated part having an undivided structure.

5. The reactor according to claim 1, comprising:

a peripheral surface engaging part formed on a peripheral surface of the inner core part; and a hole-side engaging part formed on an inner peripheral surface of the through hole of the holding member, wherein the peripheral surface engaging part is a raised portion protruding outwardly of the inner core part, and the hole-side engaging part is a recessed portion recessed outwardly of the through hole, and in which the raised portion is fitted.

6. The reactor according to claim 1, comprising:

a peripheral surface engaging part formed on a peripheral surface of the inner core part; and a hole-side engaging part formed on an inner peripheral surface of the through hole of the holding member, wherein the peripheral surface engaging part is a recessed portion recessed inwardly of the inner core part, and the hole-side engaging part is a raised portion protruding inwardly of the through hole and fitted in the recessed portion.

7. The reactor according to claim 6, wherein the peripheral surface engaging part is a circumferential groove formed around the peripheral surface of the inner core part.

8. The reactor according to claim 1, wherein the end face of the inner core part in the axial direction abuts the inward surface of the outer core part.

9. The reactor according to claim 1, wherein at least the peripheral surface of the inner core part is constituted by a molded body of a composite material including a soft magnetic powder and a resin.

* * * * *